United States Patent [19]

Iizuka

[11] 4,107,921

[45] Aug. 22, 1978

[54] FUEL-INJECTION INTERNAL COMBUSTION ENGINE

[75] Inventor: Haruhiko Iizuka, Yokosuka, Japan

[73] Assignee: Nissan Motor Company, Ltd., Japan

[21] Appl. No.: 775,056

[22] Filed: Mar. 7, 1977

[30] Foreign Application Priority Data

Mar. 8, 1976 [JP] Japan ..... 51-24108

[51] Int. Cl.[2] ..... F01N 3/15; F02D 13/06

[52] U.S. Cl. ..... 60/288; 123/198 F; 123/32 EE

[58] Field of Search ..... 60/288; 123/198 F, 119 EC, 123/32 EE, 198 DB

[56] References Cited

U.S. PATENT DOCUMENTS

| | | | |
|---|---|---|---|
| 3,192,706 | 7/1965 | Dolza | 60/285 X |
| 3,645,098 | 2/1972 | Templin et al. | 60/288 |
| 3,988,891 | 11/1976 | Hayler | 60/288 |
| 4,007,590 | 2/1977 | Nagai et al. | 123/198 F X |
| 4,024,850 | 5/1977 | Peter et al. | 123/198 F |

FOREIGN PATENT DOCUMENTS

| | | | |
|---|---|---|---|
| 2,322,057 | 11/1974 | Fed. Rep. of Germany | 60/288 |

*Primary Examiner*—Charles J. Myhre
*Assistant Examiner*—Ira S. Lazarus

[57] ABSTRACT

An automotive multiple-cylinder fuel-injection internal combustion engine comprising a plurality of power cylinders, air intake means for supplying air to each group of power cylinders, exhaust passageways each leading from each group of power cylinders, two branch passageways leading from each of the exhaust passageways, an exhaust-gas processing device in communication with one of the branch passageways leading from each of the exhaust passageways, air-fuel ratio control means adapted to control the air-to-fuel ratio of the air-fuel mixture toward a predetermined value or range in accordance with a signal representative of the concentration of oxygen in the exhaust gases discharged from the power cylinders in operative conditions, and cylinder cut-off control means responsive to the load on the engine for bringing at least one group of power cylinders into inoperative conditions when the load on the engine is diminished, the exhaust passageway being provided with valve means so that only the exhaust gases from the power cylinders in operative conditions are passed through one of the branch passageways to the exhaust-gas processing means.

4 Claims, 4 Drawing Figures

FUEL-INJECTION INTERNAL COMBUSTION ENGINE

The present invention relates in general to automotive multiple-cylinder internal combustion engines having electronically controlled fuel-injection systems and, particularly, to an automotive fuel-injection internal combustion engine having a plurality of power cylinders which are arranged to be put into operation in a number variable with the load on the engine. A fuel-injection internal combustion engine of this type is useful for achieving enhancement in the engine fuel economy because the number of the power cylinders put into operation is varied to be adequate for the load on the engine and as a consequence the engine as a whole need not consume durplus fuel during low-load operation in which a certain number of power cylinders are held inoperative.

More particularly, the present invention is concerned with an automotive fuel-injection internal combustion engine which is of the general character above described and which is further equipped with an exhaust emission control system including an exhaust-gas processing unit such as a catalytic converter provided in the exhaust system of the engine and an air-fuel ratio control arrangement which is adapted to control the air-to-fuel ratio of the combustible mixture to be supplied to the power cylinders of the engine in such a manner that the air-fuel ratio is maintained within or converged a certain range which will enable the exhaust gas processing unit to produce its maximum exhaust cleaning ability.

Objects, features and advantages of an internal combustion engine according to the present invention will be made apparent from the following description taken in conjunction with the accompanying drawings in which.

Figure 3:
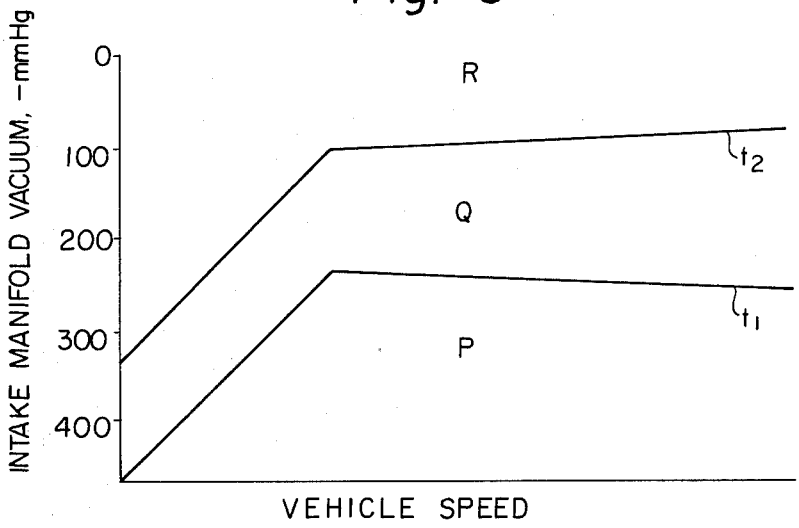
Figure 2:
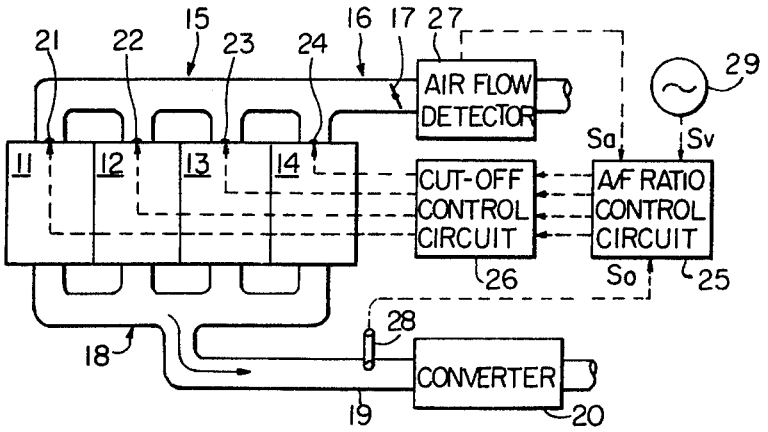
Fig. 2 PRIOR ART
FIG. 2 is a schematic view showing, partly in a block diagram, the general setups of a prior-art four-cylinder fuel-injection internal combustion engine of the described chacters.
Figure 4:
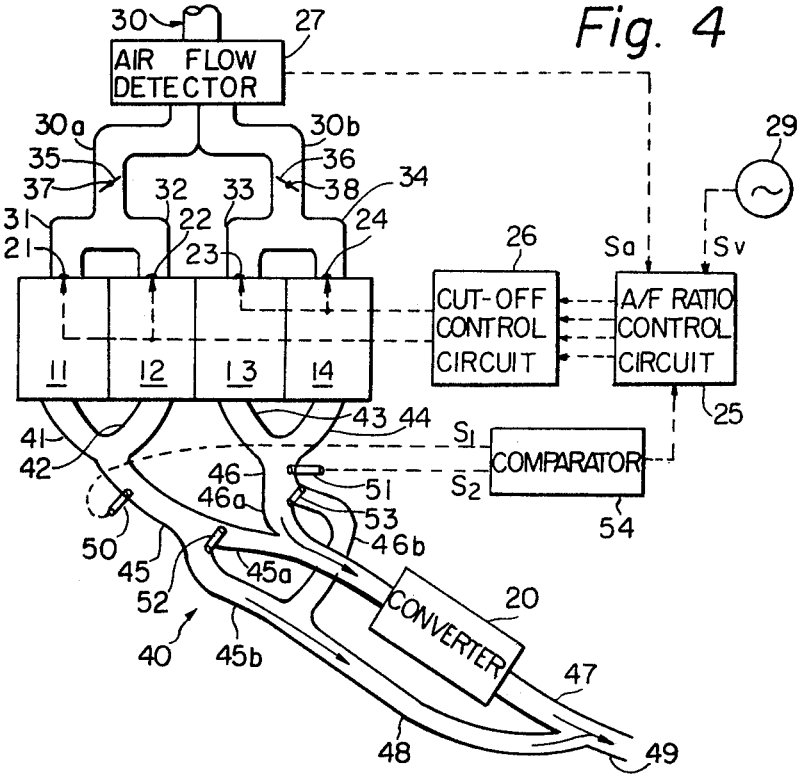

FIG. 3 is a graphic representation of an example of the program in accordance with which the internal combustion engine illustrated in FIG. 2 is to be operated depending upon the vehicle speed and the load on the engine which is represented by the vacuum developed in the intake manifold of the engine; and FIG. 4 is a schematic view showing, partly in a block diagram, the general arrangement of a preferred embodiment of a fuel-injection internal combustion engine according to the present invention.

Figure 1:
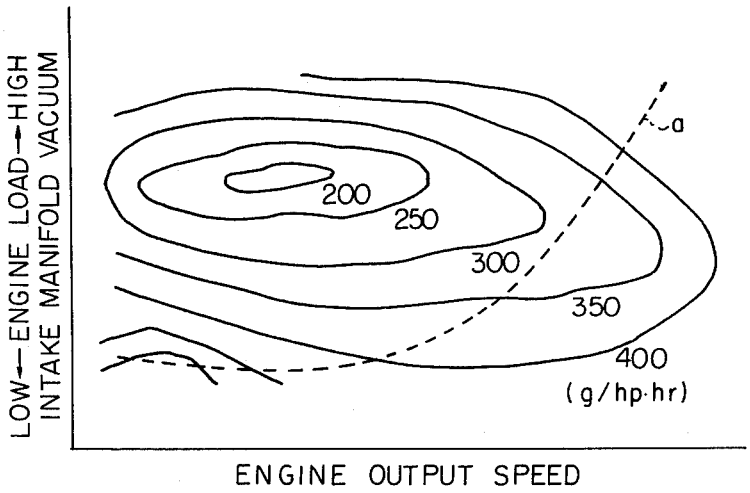
FIG. 1 is a graph showing an example of the fuel consumption characteristics of an ordinary multiple-cylinder fuel-injection internal combustion engine in which all the power cylinders of the engine are constantly put in operation when the engine is in operation.

The fuel consumption rate of an internal combustion engine is generally expressed as the quantity by weight of fuel consumed to produce a unit power output per unit time as is well known in the art and varies with the output speed of the engine and the load on the engine, viz., the vacuum developed in the intake manifold of the engine, as illustrated in FIG. 1 in which the fuel consumption rates in grams per metric horsepower hour are shown by isometric curves in terms of the engine output speed and the vacuum in the intake manifold of the engine. If, now, an automotive vehicle using an ordinary multiple-cylinder internal combustion engine having all the power cylinders put in operation when the engine is operative is driven to cruise at a constant speed with the engine operated in such conditions that are indicated by curve *a* in the graph of FIG. 1 as has been the case with a vehicle equipped with an internal combustion engine having a sufficiently large maximum allowable displacement, all the power cylinders of the engine are supplied with fuel not only when the engine is operating under high load conditions but during low-load operating conditions of the engine. This causes the engine to be supplied with an excess of fuel under low-load operating conditions and as a consequence gives rise to an increase in the average fuel consumption rate of the engine throughout the various modes of operation of the engine.

In an attempt to provide a solution to this problem, a multiple-cylinder fuel-injection internal combustion engine has been proposed in which the supply of fuel to one or more of the power cylinders of the engine is temporarily interrupted during low-load operating conditions of the engine and at the same time the load on each of the remaining power cylinders which are left operative is increased by depressing the accelerator pedal. An example of a prior-art fuel-injection internal combustion engine having such functions is schematically illustrated in FIG. 2.

Referring to FIG. 2, the prior-art fuel-injection internal combustion engine is shown to be of the four-cylinder design comprising four power cylinders 11, 12, 13 and 14. The power cylinders 11, 12, 13 and 14 have respective intake ports which are jointly in communication with an intake manifold 15. The intake manifold 15 is, in turn, in communication upstream with an air intake assembly 16 which is vented from the atmosphere through an air cleaner (not shown) connected to the inlet end of the assembly 16. The air intake assembly 16 comprises a throttle valve 17 which is mounted on a rotatable valve shaft connected, though not shown, to the accelerator pedal of the vehicle by means of a suitable mechanical control linkage. As is well known in the art, the throttle valve 17 is continuously rotatable with the valve shaft between a full throttle position producing a minimum flow of air thereacross and a maximum flow of air therethrough as the accelerator pedal is moved between the released and fully depressed positions thereof. The power cylinders 11, 12, 13 and 14 further have respective exhaust ports which jointly communicate with an exhaust manifold 18. The exhaust manifold 18 in turn is in communication with an exhaust tube 19. Though not shown, the exhaust tube 19 is open to the atmosphere through a muffler or mufflers and an exhaust tail pipe. The exhaust tube 19 is provided with exhaust-gas processing means such as a catalytic converter 20 which is adapted to be capable of oxidizing the combustible residues of, for example, hydrocarbons and carbon monoxide in the exhaust gases to be passed therethrough and/or reducing toxic nitrogen oxides in the exhaust gases into harmless compounds when the engine is in operation. The four-cylinder internal combustion engine shown in FIG. 2 is further provided with an electronically operated fuel-injection system which includes fuel injection nozzles 21, 22, 23 and 24 and a high-pressure fuel pump (not shown). The fuel injection nozzles 21, 22, 23 and 24 are respectively allocated to the individual power cylinders 11, 12, 13 and 14 and project either into the exhaust ports of the power cylinders or directly into the cylinders. Though not shown, the fuel injection nozzles 21, 22, 23 and 24 are connected to the high-pressure fuel pump through respective fuel lines and electronically operated fuel metering means so that each of the power cylinders 11, 12, 13 and 14 is supplied with fuel through the associated fuel injection nozzle during each intake stroke of the power cylinder.

The prior-art internal combustion engine illustrated in FIG. 2 further comprises control means including an air-fuel ratio control circuit 25 and a cylinder cut-off control circuit 26. The air-fuel ratio control circuit 25 is electrically connected to an air-flow detector 27, an exhaust sensor 28, and an engine-speed detector 29. The air-flow detector 27 is provided in the air intake assembly 16, and is operative to detect the flow rate of air be passed through the air intake assembly 16 to the intake manifold 15 and to produce an output signal S*a* representative of the detected flow rate of air. The exhaust sensor 28 is located in the exhaust tube 19 upstream of the catalytic converter 20 and is operative to detect the concentration of oxygen in the exhaust gases passed from the exhaust manifold 18 into the exhaust tube 19 and to produce an output signal S*o* representative of the detected concentration of oxygen in the exhaust gases. The engine-speed detector 29 is constituted by, for example, a tachometric generator connected to the output shaft (not shown) of the engine and is operative to produce an output signal S*v* which is proportional to or otherwise representative of the revolution speed of the engine output shaft. The air-fuel ratio control circuit 25 is supplied with these output signals S*a*, S*o* and S*v* from the air-flow detector 25, exhaust sensor 28 and engine-speed detector 29 and produces output signals one of which is effective to control the air-to-fuel ratio of the mixture produced in each of the power cylinders 11, 12, 13 and 14 by the air passed through the intake manifold 15 and the fuel which is delivered from each of the fuel injection nozzles 21, 22, 23 and 24. The signal thus predominant over the air-to-fuel ratio of the mixture to be produced in the engine is passed through the cylinder cut-off control circuit 26 to the fuel-injection system and regulates the quantity of the fuel to be delivered from each fuel injection nozzle during the intake stroke of each cycle of operation of each power cylinder. The other output signals of the air-fuel ratio control circuit 25 are also fed to the cylinder cut-off control circuit 26. The cylinder cut-off control circuit 26 is further supplied from various other detecting means (not shown) with signals which are representative of the vacuum in the intake manifold, the driving torque of the output shaft of the engine, the opening degree of the throttle valve 17 and/or the vehicle speed and produces a cylinder cut-off signal or signals when the various operational variables thus represented by the signals impressed directly impressed on the circuit 25 or supplied from or passed through the air-fuel ratio control circuit 25 for thereby controlling the fuel-injection system in such a manner as to interrupt the delivery of fuel from one or more of the fuel injection nozzles 21, 22, 23 and 24 depending upon the operating conditions of the vehicle as a whole, particularly of the engine thereof. FIG. 3 shows an example of the programs in accordance with which the cylinder cutoff circuit 26 may operate to achieve the above described functions.

The cylinder cut-off program illustrated in FIG. 3 is dependent on the vehicle speed and the engine load which is represented by the vacuum developed in the intake manifold of the engine. The program consists of a power-down range P, a balanced-power range Q next to the power-down range P along a first threashold curve $t_1$ and a power-up range R next to the balanced-power range Q along a second threashold curve $t_2$, wherein the ranges P, Q and R are higher in this sequence in terms of the intake manifold vacuum (in absolute values) throughout the range of the vehicle speed. When, now, the engine (which is assumed to be of the four-cylinder type as illustrated in FIG. 2) is being operated with all of its power cylinders 11, 12, 13 and 14 held operative and the operating conditions of the engine fall within the balanced-power range Q between the first and second threashold curves $t_1$ and $t_2$, all the power cylinders 11, 12, 13 and 14 are permitted to be maintained in the operative conditions with all the fuel injection nozzles 21, 22, 23 and 24 enabled to deliver fuel into the respectively associated power cylinders. If the load on the engine is then reduced as when the vehicle is on a descent and as a consequence the operating conditions of the engine are changed to fall within the powerdown range P below the first threashold curve $t_1$, the delivery of the fuel from one of the fuel injection nozzles 21, 22, 23 and 24 is interrupted and accordingly the associated power cylinder is rendered inoperative so that only three of the power cylinders are permitted to remain operative. If, under these conditions, the driver of the vehicle slightly depresses the accelerator pedal in an attempt to keep the vehicle speed unchanged, an increased load is exerted on the engine which therefore resumes the operating conditions falling within the balanced-power range Q of the program shown in FIG. 3 with the result that the engine continues to operate with the three power cylinders or, in other words, the number of the power cylinders in the operative conditions is kept unchanged insofar as the relationship falling within the balanced-power range Q is established between the vehicle speed and the load on the engine. If, however, the load on the engine is further reduced for one reason or another while the engine is being operated under such conditions, the operating conditions of the engine are shifted from the balanced-power range Q to the power-down range P and as a consequence one of the three power cylinders which have been held in the operative conditions is cut off so that the engine is operated with only two of the power cylinders thereof and resumes the operating conditions falling within the balanced-power range Q of the program illustrated in FIG. 3.

If, conversely, the engine which has been operating under the conditions falling within the balanced-power range Q with a certain number of power cylinders held in the inoperative conditions is subjected to an increased load as when the vehicle is being accelerated or on an ascent, the operating conditions of the engine are shifted from the balanced-power rage Q to the power-up range R. When this takes place, the number of the power cylinders to be in the operative conditions is increased from two to three or three to four and compensates for the increased load on the engine so that the engine resumes the conditions falling within the balanced-power range Q. The engine is in this fashion controlled to operate in such conditions that fall within the balanced-power range Q when the vehicle is running under steady-state conditions. The fuel consumption rate of the engine is maintained within a certain relatively low range when the engine is operating under the conditions falling within the balanced-power range Q and, for this reason, the average fuel consumption rate of the engine throughout the various modes of operation of the engine can be maintained at a significantly low level. The purposes for which the threashold curves $t_1$ and $t_2$ are reduced in terms of the intake manifold vacuum within a low vehicle speed range are to prevent the engine from producing unusual vibrations at low behicle speeds and to provide excellent driveability at low vehicle speeds.

While the selective cut-off of the power cylinders of a multiple-cylinder internal combustion engine in the above described manner is per se advantageous for achieving enhanced fuel economy of the engine, a problem is encountered when such an expedient is adopted in an internal combustion engine using an air-fuel ratio control system for emission control purposes.

As is well known in the art, a catalytic converter or any other type of exhaust-gas processing device adapted to convert the toxic, air-contaminative components of the exhaust gases into harmless compounds generally has such a performance characteristics that the exhaust-gas processing device exhibits a maximum peformance efficiency when supplied with exhaust gases that have resulted from air-fuel mixture proportioned to a certain air-to-fuel ratio which is intrinsic to the particular processing device. In the case of, for example, a certain type of tripple-effect cartalytic converter which is capable of converting hydrocarbons, carbon monoxide and nitrogen oxydes into harmless compounds, the maximum conversion efficiency is achieved when the exhaust gases to be processed by the catalytic converter have resulted from a stoichiometric air-fuel mixture having an air-to-fuel ratio of approximately 14.8:1 when gasoline is used as the fuel. The air-fuel ratio control circuit 25 shown in FIG. 2 is, for this reason, arranged in such a manner as to constantly converge the air-to-fuel ratio of the mixture toward such a certain value throughout or in prescribed modes of operation of the engine in accordance with the signal *So* delivered from the exhaust sensor 28. When, thus, the load on the engine is diminished and accordingly one of the power cylinders of the engine is brought into the inoperative conditions with the supply of the fuel to the cylinder interrupted, the particular cylinder is supplied with only air from the air intake system during intake strokes of the cylinder and as a consequence discharges only air into the exhaust manifold 19 during the subsequent exhaust strokes of the cylinder. The air thus delivered from the particular power cylinder is mixed in the exhaust manifold 19 with the exhaust gases from the remaining power cylinders so that the exhaust gases produced by combustion of the fuel in the cylinders held operative are diluted with the air from the inoperative cylinder. The mixture of the exhaust gases discharged from the operative power cylinders and the air discharged from the inoperative power cylinder contains air in greater proportion than the actual exhaust gases from the operative cylinders. The concentration of oxygen in such a mixture is detected by the exhaust sensor 28, which thus produces an output signal *So* carrying false information to misdirect the air-fuel ration control circuit 25 to determine that the air-fuel mixture produced in the operative power cylnders is leaner than a mixture having the target air-to-fuel ratio. As a consequence, the control circuit 25 causes the fuel-injection system to feed fuel at an increased rate to the fuel injection nozzles for the operative power cylinders which therefore produce an air-fuel mixture far richer than the mixture that should be produced. This results in waste of fuel and will not only offset the saving of the fuel by the selective cut-off of the power cylinder or cylinders but would impair the fuel economy of the engine to such an extent as to be inferior to the fuel economy of an enternal combustion engine not using the selective cut-off schemes for the power cylinders. The present invention contemplates elimination of these drawbacks inherent in a prior-art internal combustion engine of the described character.

It is, accordingly, an important object of the present invention to provide an improved multiple-cylinder fuel-injection internal combustion engine featuring cimpatibility between the enhanced fuel economy and the emission control performance.

It is another important object of the present invention to provide an improved multiple-cylinder fuel-injection internal combustion engine having cylinder cut-off means adapted to bring one or more of the power cylinders of the engine into inoperative conditions depending upon the variation in the load on the engine so as to reduce the average fuel consumption rate of the engine and emission control means adapted to regulate the air-to-fuel ratio of the air-fuel mixture to be produced in the power cylinders toward a predetermined value or range optimum for converting the toxic components of the exhaust gases into harmless compounds at a maximum efficiency regardless of changes in the number of the power cylinders which are in operation.

In accordance with the present invention, these and other objects are accomplished basically in an automotive multiple-cylinder fuel-injection internal combustion engine comprising a plurality of groups of power cylinders each having intake and exhaust ports; an air intake system incuding intake passageways each in communication with the intake ports of the power cylinders of each of the groups; a fuel-injection system including fuel injection nozzles which are respectively in communication with the intake ports of the power cylinders of all of the groups; an exhaust system including exhaust passageways each communicating with the exhaust ports of the power cylinders of each of the groups and first and second branch passageways leading from each of the above mentioned exhaust passageways; flow shut-off valve means provided between each of the exhaust passageways and the branch passageways whicb leads from the particular exhaust passageway; exhaust-gas processing means provided in the exhaust system for cleaning the exhaust gases to be passed therethrough, the respective first branch passageways leading from the aforesaid exhaust passageways being communicable downstream with the exhaust-gas processing means and the respective second branch passageways leading from the exhaust passageways by-passing the exhaust-gas processing means, the above mentioned flow shut-off valve means having a first condition providing communication between each of the exhaust passageways and the exhaust-gas processing means through the associated first branch passageway and a second condition closing the aforesaid associated first branch passageway and providing communication between each of the exhaust passageways and the second branch passageway leading from the particular exhaust passageway; exhaust sensors which are respectively provided in the exhaust passageways for detecting the concentrations oxygen in the exhaust gases to be passed through the respective exhaust passageways and thereby producing output signals which are representative of the respective detected concentrations of oxygen; comparator means operative to compare the respective output signals from the exhaust sensors with each other for passing therethrough the signal which is representative of the lowest one of the detected concentrations of oxygen; detecting means for detecting prescribed operational variables of the engine for producing output signals which are representative of the detected operational variables; air-fuel ratio control means responsive to the output signals from the comparator means and the detecting means for controlling the air-to-fuel ratio of the air-fuel mixture to be produced in the power cylinders toward a predetermined value; and cylinder cut-off control means operatively connected between the fuel-injection system and the air-fuel ratio control means for controlling the fuel injection system in such a manner as to interrupt the delivery of fuel from the fuel injection nozzles for the power cylinders of at least one of the aforesaid groups and thereby having the particular power cylinders held in inoperative conditions when the operational variables represented by the output signals delivered from the detecting means are within predetermined ranges, the cylinder cut-off control means being further operatively connected to the flow shut-off valve means for controlling the valve means between the first and second conditions thereof depending upon the signals from the detecting means so that the flow shut-off valve means is in the first condition and in the second condition thereof when the power cylinders of the group communicating with the exhaust passageway associated with the valve means are in the operative and inoperative conditions, respectively.

A preferred embodiment of a fuel-injection internal combustion engine thus basically constructed and arranged in accordance with the present invention will be hereinafter described with reference to FIG. 4 of the drawings.

In FIG. 4, the elements, units and circuits designated by the same reference numerals as used in FIG. 2 are assumed to be similar in construction and operation to their respective counterparts in the prior-art internal combustion engine described with reference to FIG. 2. The fuel-injection internal combustion engine illustrated in FIG. 4 is, thus, also assumed, by way of example, to be of the four-cylinder type consisting of a parallel combination of first, second, third and fourth power cylinders 11, 12, 13 and 14 having fuel injection nozzles 21, 22, 23 and 24, respectively, which are in communication with the respective intake ports of the power cylinders. The engine has an air intake system 30 which comprises a pair of a pair of intake passageways 30*a* and 30*b*. One intake passageway 30*a* merges downstream into a pair of branch passageways 31 and 32 communicating with the intake ports of the first and second power cylinders 11 and 12, respectively, and the other intake passageway 30*b* merges downstream into a pair of branch passageways 33 and 34 which are in communication with the intake ports of the third and fourth power cylinders 33 and 34, respectively, as shown. The intake passageways 30*a* and 30*b* are provided with throttle valves 35 and 36, respectively, which are mounted on rotatable valve shafts 37 and 38, respectively. Though not shown in the drawings, the valve shafts 37 and 38 are connected either jointly or independently of each other to the accelerator pedal of the vehicle by means of a suitable mechanical linkage similarly to the throttle valve 17 described with reference to FIG. 2. The air-flow detector 27 for producing the signal S*a* indicative of the flow rate of air to be passed through the air intake system 30 is provided in the air intake system 30 upstream of the intake passageways 30*a* and 30*b* so that the signal S*a* to be delivered from the air-flow delector 27 is representative of the flow rate of air to be passed over to all of the power cylinders 11, 12, 13 and 14 through the intake passageways 30*a* and 30*b* and then through the branch passageways 31, 32, 33 and 34.

The internal combustion engine illustrated in FIG. 4 further has an exhaust system 40 comprising passageways 41, 42, 43 and 44 which are in communication with the exhaust ports of the first, second, third and fourth power cylinders 11, 12, 13 and 14, respectively. The passageways 41 and 42 leading from the exhaust ports of the first and second power cylinders 11 and 12, respectively, jointly merge downstream into a first exhaust passageway 45 and, likewise, the passageways 43 and 44 leading from the exhaust ports of the third and fourth power cylinders 13 and 14, respectively, jointly merge downstream into a second exhaust passageway 46. The first exhaust passageway 15 is divided downstream into first and second branch passageways 45*a* and 45*b* and likewise the second exhaust passageway 46 is divided downstream into first and second branch passageways 46*a* and 46*b*. The respective first branch passageways 45*a* and 46*a*leading from the first and second exhaust passageways 45 and 46 are combined downstream into a first confluent passageway 47 and likewise the respective second branch passageways 45*b* and 46*b* leading from the first and second exhaust passageways 45 and 46 are combined downstream into a second confluent passageway 48. The first and second confluent passageways 47 and 48, in turn, are combined downstream into a single plenum passageway 49 which is downstream open to the atmosphere through a muffler or mufflers (not shown) as is customary in the art. A suitable exhaust-gas processing device such as a catalytic converter 20 is provided in the first confluent passageway 47 and is thus bypassed by the second confluent passageway 48. The catalytic converter 20 is herein schematically illustrated only in block form but is assumed, by way of example, to be of the previously described tripple-effect type which is capable of processing in a single unit hydrocarbons, carbon monoxide and nitrogen oxides in the exhaust gases to be passed therethrough. As has been discussed, a catalytic converter of the tripple-effect type has such performance characteristics as to exhibit its maximum conversion efficiency for all of these toxic air-contaminative compounds when supplied with exhaust gases resulting from a stoichiometric air-fuel mixture.

The first and second exhaust passageways 45 and 46 are provided with exhaust sensors 50 and 51, respectively. These exhaust sensors 45 and 46 are similar in effect to the exhaust sensor 28 provided in the exhaust system of the prior-art internal combustion engine illustrated in FIG. 2 and are, thus, adapted to detect the respective concentrations of oxygen in the exhaust gases passed through the first and second exhaust passageways 45 and 45 and to produce output signals $S_1$ and $S_2$, respectively, which are representative of the respective detected concentrations of oxygen. Z representative example of each of the exhaust sensors 50 and 51 herein used is of the type consisting of an electrolytic element of sintered zirconium coated with microporous platinum.

At the terminal ends of the first and second exhaust passageways 45 and 46 are provided flow shut-off valves 52 and 53, respectively, each of which has a first condition providing communication between each of the exhaust passageways 45 and 46 and each of the first branch passageways 45*a* and 46*a* or, in other words, between each of the exhaust passageways 45 and 45 and the first confluent passageway 47 as in the case of the second flow shut-off valve 53 herein shown and a second condition blocking such communication and providing communication between each of the exhaust passageways 45 and 46 and each of the second branch passageways 45*b* and 46*b*, viz., between each of the exhaust passageways 45 and 46 and the second confluent passageway 48 as is the case with the first flow shut-off valve 52 herein shown. When, thus, the first flow shut-off valve 52 is in the first condition thereof, the exhaust ports of the first and second power cylinders 11 and 12 are in communication with the first confluent passageway 47 and accordingly with the catalytic converter 20 through the first exhaust passageway 45 and the first branch passageway 45*a* downstream of the exhaust passageway 45. When the first flow shut-off valve 52 is in the second condition thereof, the exhaust ports of the first and second power cylinders 11 and 12 are in communication with the second confluent passageway 48 through the first exhaust passageway 45 and the second branch passageway 45*b* downstream of the exhaust passageway 45. Likewise, the exhaust ports of the third and fourth power cylinders 13 and 14 are in communication with the first or second confluent passageway 47 or 48 through the second exhaust passageway 46 and the first or second branch passageway 46*a* or 46*b*, respectively, downstream of the exhaust passageway 46.

The exhaust sensors 50 and 51 provided in the first and second exhaust passageways 45 and 46, respectively, are electrically connected to a comparator circuit 54 which is operative to compared the respective output signals $S_1$ and $S_2$ from the exhaust sensors 50 and 51 with each other and to pass to its output terminal the signal $S_1$ or $S_2$ which is representative of the lower one of the concentrations of oxygen represented by the two signals $S_1$ and $S_2$. The signal $S_1$ or $S_2$ thus passed through the comparator circuit 54 is fed to the previously described air-fuel ratio control circuit 25 which is adapted to be supplied with the signals S*a* and S*v* from the air-flow detector 27 and the engine-speed detector 29 as well as the signal $S_1$ or $S_2$ from the comparator circuit 54 and to deliver output signals to a cylinder cut-off circuit 56. The cylinder cut-off circuit 56 is supplied with signals from not only the air-fuel ratio control circuit 25 but from other suitable detector means (not shown) which are adapted to detect prescribed operational variables of the vehicle such as, for example, the vacuum developed in each or one of the branch passageways 30*a* and 30*b* of the air intake system 30 downstream of the throttle valve 35 or 36, the degree of opening at each or one of the throttle valves 35 and 36 and the driving torque of the output shaft (not shown) of the engine. The cylinder cut-off control circuit 56 is operatively connected to the fuel-injection system of the engine and controls the fuel-injection system in such a manner as to interrupt the deliver of fuel from the fuel injection nozzles 21 and 22 or 23 and 24 for one pair of power cylinders 11 and 12 or the other pair of power cylinders 13 and 14 for thereby having the power cylinders 11 and 12 or13 and 14 brought into inoperative conditions when the operational variables represented by the signals fed to the control circuit 56 are within predetermined ranges, particularly when, for example, the engine is subjected to an increased load which may be detected from an increase in the vacuum developed in each or one of the intake passageways 30*a* and 30*b* downstream of the throttle valve 35 or 36. The cylinder cut-off control circuit 56 is further operatively connected to the flow shut-off valves 52 and 53 so as to control each of the valves 52 and 53 between the previously described first and second conditions thereof depending upon the signals impressed on the control circuit 56 whereby each of the flow shut-off valves 52 and 53 is brought into the first condition thereof or into the second condition thereof when the power cylinders having the exhaust ports communicating with the first or second exhaust passageway 45 or 46 provided with the particular valve 52 or 53 are in the operative or inoperative conditions, respectively.

When, in operation, the vehicle equipped with the fuel-injection internal combustion engine hereinbefore described with reference to FIG. 4 is being accelerated or is climbing up a hill so that the engine is subjected to an increased load, the cylinder cut-off control circuit 56 controls the fuel-injection system in such a manner as to enable the fuel injection nozzles 21, 22, 23 and 24 for both pairs of power cylinders 11, 12, 13 and 14 to deliver fuel into the intake ports of the cylinders during respective intake strokes of the individual power cylinders. Under these conditions, the throttle valves 35 and 36 and the fuel injection system are controlled by the signals produced by the air-fuel ratio control circuit 25 so that the air-fuel mixture produced in the individual power cylinders is regulated to have an air-to-fuel ratio within a predetermined range that will enable the catalytic converter 20 to exhibit its maximum conversion efficiency. The catalytic converter 20 herein shown being assumed to be of the tripple-effect type as previously noted, the air-fuel ratio control circuit 25 is preferably arranged to produce a stoichiometric mixture in the power cylinders. When all the power cylinders 11, 12, 13 and 14 are thus held in the operative conditions, the flow shut-off valves 52 and 53 are held, under the control of the cylinder cut-off control circuit 56, in the respective first conditions thereof providing communication between each of the first and second exhaust passageways 45 and 46 and each of the first branch passageways 45*a* and 46*a*. The exhaust gases emitted from the individual power cylinders 11, 12, 13 and 14 are, therefore, passed through the passageways 41, 42, 43 and 44, first and second exhaust passageways 45 and 46 and the first branch passageways 45*a* and 45*b* past the flow shut-off valves 52 and 53 into the first confluent passageway 47 equipped with the catalytic converter 20.

When the load on the engine is thereafter diminished, then the cylinder cut-off control circuit 56 controls the fuel-injection system in such a manner as to cut off the delivery of fuel from the fuel injection nozzles 21 and 22 for one pair of power cylinders 11 and 11 or the fuel injection nozzles 23 and 24 for the other pair of power cylinders 13 and 14. If, in this instance, it is assumed that the first and second power cylinders 11 and 12 are brought into the inoperative conditions thereof with the third and fourth power cylinders 13 and 14 maintained in the operative conditions thereof, the flow shut-off valve 52 is moved into the second condition thereof under the control of the cylinder cut-off control circuit 56 as illustrated in FIG. 4 with the result that the communication between the first exhaust passageway 45 and the first branch passageway 45a downstream of the exhaust passageway 45 is blocked and alternately communication is established between the exhaust passageway 45 and the second branch passageway 45b downstream of the exhaust passageway 45. In the absence of the delivery of fuel from the fuel injection nozzles 21 and 22, the first and second power cylinders 11 and 12 discharge only fresh air from their exhaust ports. The air thus delivered into the first exhaust passageway 45 is passed to the second confluent passageway 48 by way of the second branch passageway 45b past the flow shut-off valve 52. On the other hand, the exhaust gases discharged from the third and fourth power cylinders 13 and 14 which are held in the operative conditions are passed over to the first confluent passageway 47 as above noted and are processed by the catalytic converter 20. The exhaust gases thus cleared of toxic, air-contaminative compounds by the catalytic converter 20 are passed to the plenum passageway 49 in which the exhaust gases are mixed with the air discharged from the first and second power cylinders 11 and 12. When only air is being passed through the first exhaust passageway 45 as above described, the concentration of oxygen represented by the signal $S_1$ produced by the exhaust sensor 50 in the first exhaust passageway 45 is far higher than the concentration of oxygen represented by the signal $S_2$ produced by the exhaust sensor 51 in the second exhaust passageway 46 so that the comparator circuit 54 supplied with these signals $S_1$ and $S_2$ passes the signal $S_2$ therethrough to the air-fuel ratio control circuit 25. The air-fuel ratio control circuit 25 is thus supplied with information correctly indicative of the air-to-fuel ratio of the mixture produced in the third and fourth power cylinders 13 and 14 and is therefore enabled to properly control the flow rate of air to be passed through the air intake passageway 30b leading to the intake ports of the third and fourth power cylinders 13 and 14 and the rates of delivery of fuel from the fuel injection nozzles 23 and 24 for the power cylinders 13 and 14. The catalytic converter 20 is in this fashion enabled to produce its maximum conversion efficiency independently of the air discharged from the first and second power cylinders 11 and 12 and passed through the second confluent passageway 48 by-passing the catalytic converter. When the power cylinders 11 and 12 are thus held in the inoperative conditions, it is preferable that the throttle valve 35 in the intake passageway 30a leading to the particular power cylinders be controlled to be fully open for the purpose of minimizing the pumping loss of the engine.

In the embodiment of FIG. 4, it has been assumed that the two pair of power cylinders 11, 12, 13 and 14 can be alternatively brought into the inoperative conditions. If desired, however, the embodiment of FIG. 4 may be modified in such a manner that one pair of power cylinders is maintained in the operative conditions throughout the operation of the engine and only the other pair of power cylinders can be shifted between the operative and inoperative conditions depending upon the load on the engine. If, in this instance, the first and second power cylinders 11 and 12 are to be arranged to be shifted between the operative and inoperative conditions with the third and fourth power ctlinders 13 and 14 maintained in the operative conditions throughout the operation of the engine, the second branch passagewat 46b leadinng from the second exhaust passageway 46, the flow shut-off valve 53 in the second exhaust passageway 46, the exhaust sensor 50 in the first exhaust passageway 45 and the comparator circuit 54 may be dispensed with so that the second exhaust passageway 46 is in constant communication with the first confluent passageway 47 and the exhaust sensor 51 in the second exhaust passageway 46 is connected direct to the air-fuel ratio control circuit 25.

While, furthermore, the power cylinders 11, 12, 13 and 14 of the embodiment of FIG. 4 are arranged in two groups, this is merely for the purpose of illustration and, if desired, the power cylinders may be arranged in any desired number of groups depending upon the number of cylinders to be in use.

What is claimed is:

1. An automotive multiple-cylinder fuel-injection internal combustion engine comprising:

(1) a plurality of groups of power cylinders each having intake and exhaust ports, (2) an air intake system including intake passageways each communicating within the intake ports of the power cylinders of each of said groups, (3) a fuel-injection system including fuel injection nozzles respectively communicating with the intake ports of the power cylinders of said groups, (4) an exhaust system including (a) exhaust passageways each communicating with the exhaust ports of the power cylinders of each of said groups and (b) first and second branch passageways leading downstream from each of said exhaust passagways, (5) flow shut-off valve means provided between each of said exhaust passageways and the branch passagways leading from the particular exhaust passageway, (6) exhaust-gas processing means provided in said exhaust system for cleaning the exhaust gases to be passed therethrough, the respective first branch passageways leading from said exhaust passageways being communicable downstream with said exhaust-gas processing means and the respective second branch passageways leading from said exhaust passageways by-passing the exhaust-gas processing means, said flow shut-off valve means having a first condition providing communication between each of said exhaust passageways and said exhaust-gas processing means through the associated first branch passageway and a second condition closing said associated first branch passageway and providing communication between each of the exhaust passageways and the second branch passageway leading from the particular exhaust passageway, (7) exhaust sensors respectively provided in said exhaust passageways for detecting the concentrations of oxygen in the exhaust gases to be passed through the respective exhaust passageways and thereby producing output signals representative of the respective detected concentrations of oxygen, (8) comparator means operative to compare the respective output signals from said exhaust sensors with each other for passing therethrough the signal which is representative of the lowest one of said detected concentrations of oxygen;

(9) detecting means for detecting prescribed operational variables of the engine for producing output signals representative of the detected variables,

(10) air-fuel ratio control means responsive to the signals from said comparator means and said detecting means for controlling the air-to-fuel ratio of the air-fuel mixture to be produced in the power cylinders toward a predetermined value;

(11) cylinder cut-off control means operatively connected between said fuel-injection system and said air-fuel ratio control means for controlling the fuel-injection system in such a manner as to interrupt the delivery of fuel from the fuel injection nozzles for the power cylinders of at least one of said groups and thereby having the particular power cylinders held in inoperative conditions when the operational variables represented by said output signals from said detecting means are within said predetermined ranges, said cylinder cut-off control means being further operatively connected to said flow shut-off valve means for controlling the valve means between the first and second conditions thereof depending upon the signals from said detecting means so that the valve means is in the first condition and in the second condition thereof when the power cylinders of the group communicating with the exhaust passageway which is associated with the particular valve means are in the operative and inoperative conditions, respectively.

2. An automotive multiple-cylinder fuel-injection internal combustion engine as set forth in claim 1, in which said exhaust system further includes a first confluent passageway communicating upstream with the respective first branch passageways leading from said exhaust passageways and a second confluent passageway communicating upstream with the respective second branch passageways leading from said exhaust passageways, said exhaust-gas processing means being provided in said first confluent passageway.

3. An automotive multiple-cylinder fuel-injection internal combustion engine as set forth in claim 1, in which said detecting means includes an air-flow detector provided in said air intake system upstream of said intake passageways and connected to said air-fuel ratio control means.

4. An automotive multiple-cylinder fuel-injection internal combustion engine as set forth in claim 1, in which said detecting means includes an engine-speed sensor connected to said air-fuel ratio control means.

* * * * *